US012006770B2

(12) United States Patent
Stenberg et al.

(10) Patent No.: US 12,006,770 B2
(45) Date of Patent: Jun. 11, 2024

(54) METHOD AND SYSTEM FOR ESTIMATING WEAR OF A DRILL BIT

(71) Applicant: EPIROC ROCK DRILLS AKTIEBOLAG, Orebro (SE)

(72) Inventors: Goran Stenberg, Fagersta (SE); Erik Rosendal, Orebro (SE)

(73) Assignee: Epiroc Rock Drills Aktiebolag, Örebro (SE)

( * ) Notice: Subject to any disclaimer, the term of this patent is extended or adjusted under 35 U.S.C. 154(b) by 45 days.

(21) Appl. No.: 17/596,431

(22) PCT Filed: Jul. 3, 2020

(86) PCT No.: PCT/SE2020/050705
§ 371 (c)(1),
(2) Date: Dec. 10, 2021

(87) PCT Pub. No.: WO2021/006800
PCT Pub. Date: Jan. 14, 2021

(65) Prior Publication Data

US 2022/0268103 A1 Aug. 25, 2022

(30) Foreign Application Priority Data

Jul. 5, 2019 (SE) ..... 1950851-4

(51) Int. Cl.
*E21B 10/36* (2006.01)
*E21B 7/02* (2006.01)

(52) U.S. Cl.
CPC ..... *E21B 10/36* (2013.01); *E21B 7/025* (2013.01)

(58) Field of Classification Search
CPC . E21B 1/00; E21B 10/36; E21B 12/02; E21B 6/00; E21B 1/02; E21B 1/12
See application file for complete search history.

(56) References Cited

U.S. PATENT DOCUMENTS 3,714,822 A 2/1973 Lutz
4,773,263 A 9/1988 Lesage et al.
(Continued)

FOREIGN PATENT DOCUMENTS

CN 1750905 A 3/2006
CN 101983274 A 3/2011
(Continued)

OTHER PUBLICATIONS

Swick et al., "Mechanism of wear of the rotary-percussive drilling bits and the effect of rock type on wear", Tribology International, vol. 25. No. 1, Jan. 1, 1992, pp. 83-88 (hereinafter Swick) (Year: 1992).*

(Continued)

*Primary Examiner* — Caroline N Butcher
(74) *Attorney, Agent, or Firm* — Sage Patent Group

(57) ABSTRACT

A method for estimating wear of a drill bit in percussive rock drilling. A percussion device is configured for generating shock waves in a drill bit for breaking rock. The method includes, during drilling determining a percussion frequency of the percussion device; and estimating wear of the drill bit based on the determined percussion frequency of the percussion device and a model representation of the wear of the drill bit as a function of percussion frequency, wherein the model representation is configured to output the estimated wear of the drill bit utilizing the determined percussion frequency as input signal.

18 Claims, 6 Drawing Sheets

(56) References Cited

U.S. PATENT DOCUMENTS

| | | | | |
|---|---|---|---|---|
| 4,928,521 | A | 5/1990 | Jardine | |
| 5,305,836 | A | 4/1994 | Holbrook et al. | |
| 6,367,565 | B1 * | 4/2002 | Hall | E21B 41/0085 175/50 |
| 2003/0015351 | A1 | 1/2003 | Goldman et al. | |
| 2004/0059554 | A1 | 3/2004 | Goldman et al. | |

FOREIGN PATENT DOCUMENTS

| | | | | |
|---|---|---|---|---|
| CN | 102791953 | A | 11/2012 | |
| CN | 108138560 | A | 6/2018 | |
| CN | 208168799 | U | 11/2018 | |
| EP | 3617441 | A1 * | 3/2020 | E21B 1/00 |
| WO | 2010117331 | A1 | 10/2010 | |

OTHER PUBLICATIONS

International Search Report and Written Opinion in corresponding International Application No. PCT/SE2020/050705 dated Oct. 20, 2020 (9 pages).

K. J. Swick et al; "Mechanism of wear of rotary-percussive drilling bits and the effect of rock type on wear"; Tribology International; Jan. 1, 1992; vol. 25; No. 1; ISSN: 0301-679X/92/010083-6; pp. 83-88 (6 pages).

Office Action dated Oct. 18, 2023 for Chinese Patent Application No. 202080043312.4, 8 pages.

Zhang, Qiang et al.; "Numerical simulation analysis on the drill bit rock breaking process based on ABAQUS"; Journal of Vibration and Shock, 2018, 37(1):136-141; doi: 10.13465/j.cnki.jvs.2018.01.021; English Abstract provided; 3 pages.

* cited by examiner

METHOD AND SYSTEM FOR ESTIMATING WEAR OF A DRILL BIT

CROSS-REFERENCE TO RELATED APPLICATIONS

This application is a U.S. National Stage application of PCT/SE2020/050705, filed Jul. 3, 2020 and published on Jan. 14, 2021 as WO 2021/006800, which claims the benefit of Swedish Patent Application No. 1950851-4 filed on Jul. 5, 2019, all of which are hereby incorporated by reference in their entireties.

FIELD OF THE INVENTION

The present invention relates to percussive rock drilling, and, more specifically, to a method and system for estimating wear of a drill bit. The invention also relates to a drill rig, as well as a control system that implements the method according to the invention.

BACKGROUND OF THE INVENTION

Rock drilling rigs may be used in a number of areas of application. For example, rock drilling rigs may be utilised in tunnelling, surface mining, underground mining, rock reinforcement, raise boring, and be used e.g. for drilling blast holes, grout holes, holes for installing rock bolts, water wells and other wells, piling and foundations drilling etc. There is hence a vast use for rock drilling rigs.

Furthermore, the actual breaking of the rock is oftentimes carried out by a drill bit contacting the rock, where the drill bit is connected to a drilling machine, in general by means of a drill string. The drilling can be accomplished in various ways, e.g. as rotational drilling where the drill bit is pushed towards the rock at high pressure to crush the rock by means of rotation force and applied pressure.

The drilling may also be of a percussive type, where, for example, a percussion device, such as a hammer device, repeatedly strikes the drill bit, directly, or via a drill string, to transfer percussive pulses to the drill bit and further into the rock.

Percussive drilling may be combined with rotation in order to obtain a drilling where buttons, inserts, of the drill bit strikes fresh rock at each stroke, thereby increasing the efficiency of the drilling.

The drill bit may be pressed against the rock by means of a feed force during drilling to ensure that as much impact energy as possible from the percussion device is transmitted to the rock.

The above drilling principles have in common that the rock is crushed during drilling. However, in order to obtain an efficient drilling process, the drill bit must not be worn to an extent where drilling no longer can be carried out at as expected.

SUMMARY OF THE INVENTION

An object of the invention is to provide a method and system that is capable of estimating wear of a drill bit. A further object of the invention is to provide a method and system that is capable of presenting the estimated wear in relation to a state of wear representing a need for replacement of the drill bit. For example, the estimated wear may be presented as a drilling length/depth, such as a number of meters, that remain until it is considered that a drill bit needs to be replaced.

According to the present invention, it is provided a method for estimating wear of a drill bit in percussive rock drilling, wherein a percussion device is configured for generating shock waves in a drill bit for breaking rock;

the method comprising, during drilling:

determining a percussion frequency of the percussion device; and estimating wear of the drill bit based on the determined percussion frequency of the percussion device and a model representation of the wear of the drill bit as a function of percussion frequency, wherein said model representation is configured to output said estimated wear of the drill bit utilising said determined percussion frequency as input signal.

The drilling may be carried out through the use of a rock drilling rig, wherein the rock drilling rig may comprise a carrier, and wherein, during drilling, a drill string carried by the carrier may connect the percussion device to the carrier.

Drilling may be carried out through the use of a percussion device, such as a DTH hammer, top hammer or any other kind of percussion device. Embodiments of the invention relate to any such percussion device, and hence to percussion devices that repeatedly strikes a drill bit, directly, or via a drill string, to transfer percussive pulses, shockwaves, into the drill bit and further into the rock for breaking/crushing thereof.

However, in order to obtain an efficient drilling process, the drill bit must not be worn to an extent where drilling no longer can be carried out to the desired extent or at the desired drilling rate.

According to embodiments of the invention, it is an object to provide a method for estimating the current wear of a drill bit while drilling is in progress, so that thereby it may be determined whether a drill bit is about to reach a state of wear that represents a need to be replaced prior to the drill bit actually becomes worn to an extent where it must be replaced. In general, there exist various reasons for replacing a drill bit. For example, as a drill bit becomes worn, the drilling rate/speed deteriorates, and the drilling rate may be reduced to an extent where continued drilling no longer being feasible, e.g. because of the low drilling rate.

Drill bits may sometimes also be prematurely replaced e.g. by an operator of a drill rig being used to carry out the percussive rock drilling in order to ensure that the drill bit does not reach a state of wear where drilling cannot be continued during drilling, so that thereby it may be ascertained that a subsequent hole will be possible to drill to the end without the risk for the drill bit becoming too worn as drilling is ongoing.

A drill bit that is worn to the extent where it needs to be replaced may also impose excessive wear on parts of the overall system. For example, components such as drill string, percussive device, rotation unit etc. may be subjected to excessive wear, where this may be due to e.g. higher energies being reflected as the worn drill bit strikes the rock and less energy of the shockwaves actually being transferred to the rock and reflected instead.

The inventors of the present invention have realised that a relation between the percussion frequency and wear of a drill bit may be utilised to determine a state of wear of the drill bit. The determined percussion frequency of the percussion device is input as input signal to a model representation of the wear of the drill bit, where the model representation is configured to output said estimated wear of the drill bit utilising said determined percussion frequency as input signal.

According to embodiments of the invention, the percussion frequency is therefore determined during drilling, where the percussion frequency may be determined e.g. by being measured and/or estimated and/or through suitable signal processing, such as frequency analysis of a signal from which the percussion frequency may be determined. According to embodiments of the invention, the percussion frequency is determined from signals of an accelerometer sensing accelerations caused by the percussion device. According to embodiments of the invention, instead or in addition, the percussion frequency is determined from pressure variations occurring in hydraulic or pneumatic pressure signals, e.g. pressure signals representing the pressure of a damping chamber, and/or other suitable pressures comprising fluctuations reflecting the percussion frequency. The percussion frequency may also be determined in various other ways.

According to embodiments of the invention, a value of at least one additional parameter may be determined in addition to determining the percussion frequency, where the model representation may be configured to output the estimated wear of the drill bit utilising both the percussion frequency and the value of the at least one additional parameter as input signal to the model representation. This may further increase accuracy in the estimation of the wear of the drill bit. As is discussed further below, such additional parameters may also be utilised in the model generation. Such additional parameters may comprise e.g. one or more from: rate of penetration, weight on bit and/or feed force, drilled depth and/or current length of the drill string, e.g. represented by a current number of drill rods.

Using the model representation, the wear of the drill bit may be determined as soon as drilling is ongoing through the use of the percussion frequency and the model representation, and changes in wear as time progress may also be determined and displayed e.g. to an operator. This allows, for example, that a drill bit may be replaced prior to commencing drilling of a new hole in case it is determined that the remaining capacity of the drill bit prior to a need for replacement arises may not be sufficient to complete a hole of a desired length.

According to embodiments of the invention, it may be ensured that a current pressure of the fluid, i.e. gas or liquid or mixture thereof powering the percussion device corresponds to a pressure for which the model representation is valid when the percussion frequency is determined. In this way, it may be ensured that there exists a valid relation between the currently determined percussion frequency and wear. In such cases it may not be necessary to determine the pressure of the fluid powering the percussion device explicitly, but it may be determined whether drilling is ongoing using normal drilling parameters. For example, it may be determined whether a pneumatic or hydraulic flow powering a percussion device corresponds to a flow for which the model representation is valid, such as a flow normally being used. The invention may also be utilised irrespective of the prevailing pressure of the fluid powering the percussion device as is further discussed below.

According to embodiments of the invention, as will be further explained, the percussion frequency may be normalised in relation to the prevailing pressure of the fluid powering the percussion device to thereby benefit from a relation between wear and normalised percussion frequency that may be valid for a plurality of actual pressures of the fluid powering the percussion device.

A signal representing the current state of wear of the drill bit may be generated during drilling, so that e.g. an operator or other system functions may become aware of the current state of wear.

The signal representing a state of wear may, for example, be configured to indicate the state of wear in various different ways. For example, the state of wear may be indicated as a number of meters of drilling remaining until it is considered that the drill bit needs to be replaced. Alternatively, or in addition, the wear may be represented by a percentage of use, or other similar measure, of the current drill bit. The wear may also be indicated e.g. as a measure of a wear flat portion of drill bit inserts of the drill bit. One or more indications of the illustrated kind may e.g. be displayed to an operator of the drill rig.

The model representation may be determined once, to then be utilised e.g. throughout the service life of a drill rig. The model representation may be a data driven model, i.e. a model which is generated from data that has been collected during previous drilling.

In particular, the model representation may be generated by, during drilling:

measuring a state of wear of a drill bit for a plurality of different drilled distances during drilling with the drill bit, and determining and recording a representation of the percussion frequency at least for the corresponding drilled distances for which the state of wear is determined.

According to embodiments of the invention, with regard to the percussion frequency, the determining and recording of a representation of the percussion frequency may be performed e.g. continuously and/or at predetermined intervals. The state of wear of the drill bit may, e.g. because of the oftentimes tedious work of retracting a drill string in order to be able to measure the wear, be determined considerably less frequent. Therefore, there may be a plurality of different determinations of the percussion frequency between two consecutive measurements of the wear of the drill bit. This data may still be input to the model generator when generating the data driven model. Corresponding measures of the wear may e.g. be interpolated for determinations of the percussion frequency for which there is no actual corresponding measurement of the wear. The percussion frequency may be determined e.g. 1 or a plurality of times per second, or more or less frequent.

According to embodiments of the invention, the state of wear may be measured for a plurality of different drilled distances for each of a plurality of drill bits, and corresponding percussion frequencies may be determined for the various measured states of wear and at times therebetween as discussed. The model representation may hence be generated using data collected from drilling using a plurality of drill bits.

According to embodiments of the invention, the model representation is a model representation that has been generated utilising a normalised percussion frequency, i.e. the determined percussion frequencies are normalised. This may be utilised e.g. to allow measurements from drilling using different pressures of the fluid powering the percussion device to still be used in the model generation. The percussion frequency is in general dependent on the pressure of the fluid powering the percussion device, and such dependencies may be compensated for using normalisation.

According to embodiments of the invention, the state of wear of the drill bit is modelled as being proportional to the normalised percussion frequency when squared.

According to embodiments of the invention, the wear of the drill bit is determined using a model representation that has been generated from further parameters than percussion frequency and measured wear. That is, at least one additional parameter in addition to the percussion frequency is determined for each state of wear, and where the one or more additional parameters may be determined e.g. continuously during drilling to be used as input in the model regeneration. For example, the rate of penetration, i.e. the speed at which the drilling progress, e.g. measured in distance drilled per time unit may be utilised in addition to the percussion frequency.

In addition, or alternatively, the weight on bit (WOB) and/or feed force acting on the drill bit during drilling may be utilised. The weight on bit may be represented by the pressure/force that is applied to the drill bit in order to press it against the rock to be broken. The weight on bit may also take the current weight of the drill string into account.

Furthermore, the currently drilled hole depth, and/or current length of the drill string, e.g. represented by current number of drill rods, may also be used as input parameter. In addition to adding weight on the drill bit, each drill rod of the drill string increases friction losses of the pressurised fluid being provided to a DTH hammer, with the result that the actual pressure of the fluid reaching the percussion device may be lower than the prevailing pressure of the fluid when leaving the drill rig carrier.

One or more parameters according to the above may hence be determined may hence be continuously determined and be utilised in the model generation in addition to the percussion frequency, where the determined data may be synchronised with the corresponding percussion frequency and measured wear.

The one or more additional parameters may also e.g. be normalised.

According to embodiments of the invention, less parameters may be utilised in the generated model than the number of parameters for which data is collected. For example, as discussed, in addition to percussion frequency, data may be collected e.g. for rate of penetration, weight on bit, drilled depth etc. However, all such parameters need not be utilised in the model generation, and/or in the generated model, but e.g. only percussion frequency may be utilised, or percussion frequency and a subset of the further parameters may be utilised.

According to embodiments of the invention, the percussion device is a percussion device powered by a flow of pressurised gas such as air. According to embodiments of the invention, the percussion device is a percussion device powered by a hydraulic fluid.

According to embodiments of the invention, a signal representing the state of wear may be arranged to be provided as soon as drilling is ongoing, i.e. irrespective of e.g. prevailing pressure of the fluid powering the percussion device, where the state of wear may be displayed e.g. on a display as discussed above. However, according to embodiments of the invention, the signal representing the state of wear may be considered to be fully representative only when a predetermined time has lapsed since the drilling started, and/or when the drilling has reached normal drilling e.g. with regard to pressure of the fluid powering the percussion device, so that the drilling parameters are representative for the situation that prevailed when data was collected for the generation of the model representation. In case the state of wear may not be fully representative, this may be indicated, e.g. on a display, where the indication may be no longer displayed when the conditions for accurate estimation of the state of wear are considered to be fulfilled. According to embodiments of the invention, instead, a compensation factor may be utilised when drilling conditions differ from conditions that prevailed when generating the model representation. It is to be noted, however, that situations of this kind may be very short in terms of the time it takes to drill a hole, and in general no particular measures need therefore be taken.

Furthermore, a drill rig may be utilised using different drill bits, and/or different combinations of drill bits and/or percussion devices and/or drill strings/drill rods. According to embodiments of the invention, individual model representations may be utilised for each of a plurality of such combinations, and e.g. be stored in a control system of a drill rig for use in the estimation of a state of wear, where e.g. the control system may be configured to select a proper model based on data identifying the relevant components, which oftentimes are already present and/or input into the control system in connection with use of the drill rig.

According to embodiments of the invention, the drill bit is a drill bit comprising at least one of a plurality of front drill bit insets and a plurality of peripheral drill bit inserts. According to embodiments of the invention, when the drill bit is a drill bit comprising front drill bit inserts and peripheral drill bit inserts, different model representations may be utilised for the front drill bit inserts and the peripheral drill bit inserts, respectively.

It will be appreciated that the embodiments described in relation to the method aspect of the present invention are all applicable also for the system aspect of the present invention. That is, the system may be configured to perform the method as defined in any of the above described embodiments. Further, the method may be a computer implemented method which e.g. may be implemented in one or more control units of a drill rig.

Further characteristics of the present invention and advantages thereof are indicated in the detailed description of exemplary embodiments set out below and the attached drawings.

DETAILED DESCRIPTION OF EXEMPLARY EMBODIMENTS

Embodiments of the present invention will be exemplified in the following in view of a particular kind of drill rig where drilling is carried out through the use of a percussion device in the form of a down-the-hole (DTH)/in-the-hole (ITH) hammer. The invention is, however, applicable also for other kinds of drill rigs that comprises a DTH/ITH percussion device. According to embodiments of the invention, the drill rig is instead of a kind comprising a percussion device in the form of a top hammer. The drill rig may also be of any other kind where drilling is carried out through the use of a percussion device for generating shock waves into a drill tool for breaking rock. The invention is also applicable irrespective of whether drilling is carried out using a pneumatic or hydraulic percussion device.

Figure 1:
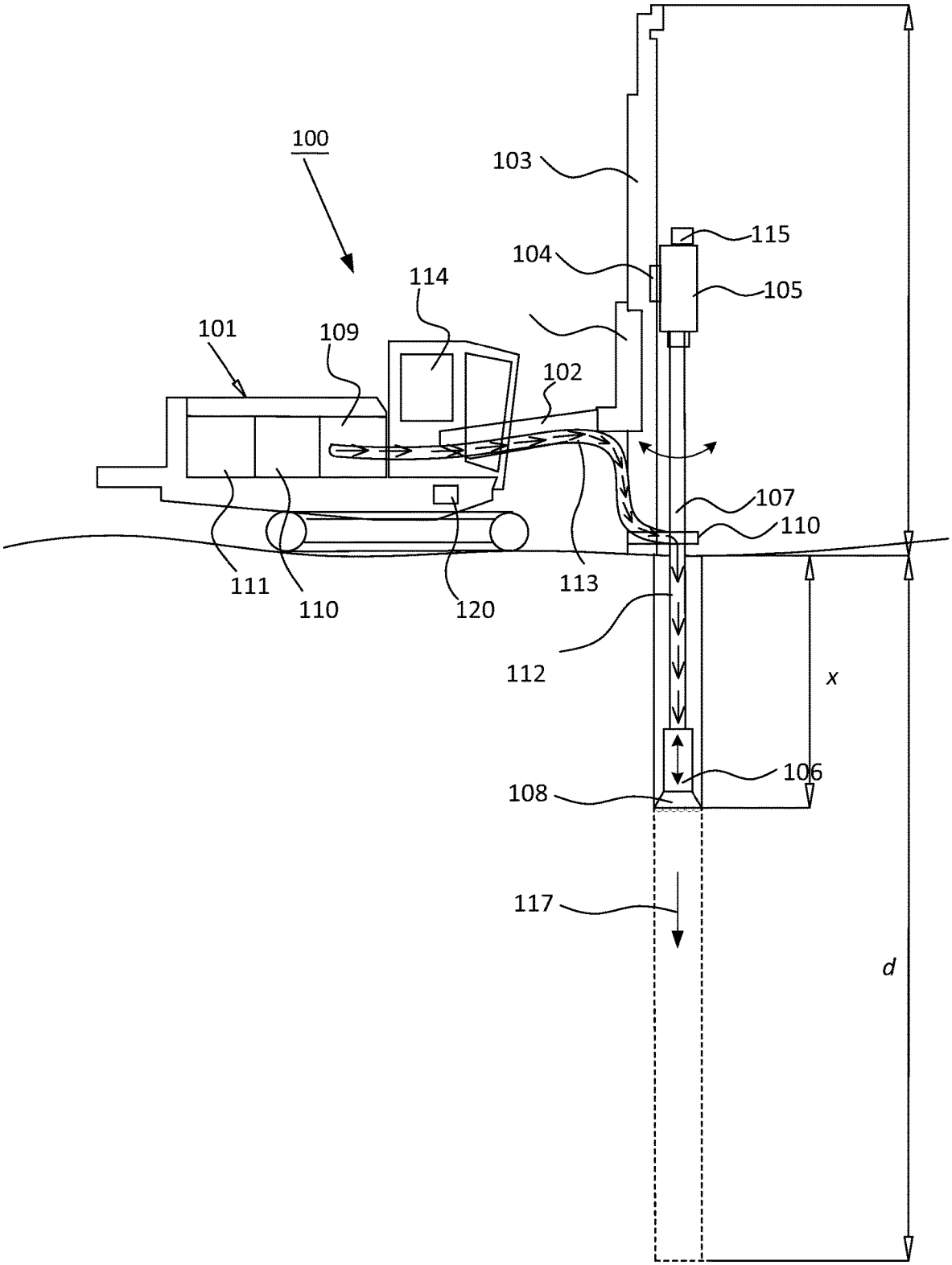
FIG. 1 illustrates an exemplary drill rig in which embodiments of the invention may be utilised.

FIG. 1 illustrates a rock drilling rig 100 according to a first exemplary embodiment of the present invention for which an inventive method of determining wear of a drill bit will be described. The drill rig 100 is in the process of drilling a hole having an expected finished depth d, and where the drilling currently has reached a depth x.

The rock drilling rig 100 according to the present example constitutes a surface drill rig, although it is to be understood that the drill rig may also be of a type being primarily intended e.g. for underground drilling, or a drill rig for any other use. The rock drilling rig 100 comprises a carrier 101, which carries a boom 102 in a conventional manner. Furthermore, a feed beam 103 is attached to the boom 102. The feed beam 103 carries a carriage 104, which is slidably arranged along the feed beam 103 to allow the carriage 104 to run along the feed beam 103. The carriage 104, in turn, carries a rotation unit 105 which hence may run along the feed beam 103 by sliding the carriage 104.

In use, the rotation unit 105 provides rotation of a drill bit 108, and the rotation unit 105 is connected to a percussion device in the form of a down-the-hole (DTH) hammer 106 by means of a drill string 107. The rotation unit 105, in addition to rotating the drill string 107, also provides a feed force acting on the drill string 107 to thereby press the drill bit 108 against the rock face being drilled.

As the name implies, the DTH hammer (percussion device) 106 works down the hole at the end of the drill string 107, where an impact piston (not shown) of the DTH hammer 106 strikes the drill bit 108 in order to transfer shock wave energy to the drill bit 108 and further into the rock for breaking thereof. DTH hammers are useful, inter alia, in that the drilling rate is not considerably affected by the length/depth of the hole being drilled.

The rotation provided by the rotation unit 105 hence transmits the rotation to the hammer 106, and thereby drill bit 108, via the drill string 107. For practical reasons (except possibly for very short holes) the drill string 107 in general does not consist of a drill string in one piece, but consists, in general, of a number of drill rods. When the drilling has progressed a distance corresponding to a drill rod length, a new drill rod is threaded together with the one or more drill rods that already has been threaded together to form the drill string, whereby drilling can progress for another drill rod length before a new drill rod is threaded together with existing drill rods. Drill rods of the disclosed kind may be extended essentially to any desired length as drilling progress, and the hole being drilled becomes deeper and deeper. The length/depth of the hole to be drilled may e.g. be in the order of 3-300 meters but may also be less or more.

According to the illustrated example, the DTH hammer 106 is driven by compressed air (illustrated by arrows), and for this reason compressed air is led to the hammer 106 through a channel 112 inside the drill string 107, where the compressed air is supplied to the drill string 107 from a tank 109 through a suitable coupling 110 as is known per se, and a hose 113 or other suitable means. The compressed air is generated by a compressor 110, which may charge the tank 109 from which the compressed air is supplied to the drill string. The compressor 110 is driven by a power source 111, e.g. in the form of a combustion engine such as a diesel engine (the power source 111 may also consist of any other suitable power source, such as e.g. an electric motor). Exhaust air from the DTH hammer 106 may be discharged through holes in the drill bit to be used to clean the drill hole from drilling remnants.

According to the present example, the drill rig 100 further comprises an accelerometer 115, which is attached to the rotation unit 105. The accelerometer 115 senses accelerations that the drill rig 100 and, according to the present example, in particular accelerations that the rotation unit 105 are subjected to from the percussive action of the DTH hammer 106 which is translated through the drill string 107.

The rock drilling rig 100 further comprises a rig control system comprising at least one control unit 120. The control unit 120 is configured to control various of the functions of the drill rig 100, such as controlling the drilling process. In case the drill rig 100 is manually operated, the control unit 120 may receive control signals from the operator, e.g. being present in an operator cabin 114 through operator controllable means such as joysticks and other means requesting various actions to be taken, and where the control signals, such as operator inflicted joystick deflections and/or maneuvering of other means, may be translated by the control system to suitable control commands. The control unit 120 may, for example, be configured to request motions to be carried out by various actuators such as cylinders/motors/pumps etc., e.g. for maneuvering boom 102, feeder 103 and controlling the rotation unit 105 and DTH hammer 106, and various other functions. The described control, as well as other functions, may alternatively be partly or fully autonomously controlled by the control unit 120.

Drill rigs of the disclosed kind may comprise more than one control unit, e.g. a plurality of control units, where each control unit, respectively, may be arranged to be responsible for monitoring and carrying out various functions of the drill rig 100. For reasons of simplicity, however, it will be assumed in the following that the various functions are controlled by the control unit 120.

Control systems of the disclosed kind may further comprise a data bus not shown), which may e.g. be a CAN bus, or any other suitable kind of data bus, and which may be used to allow communication between various units of the machine 100, and which may utilise e.g. CANopen and/or a similar protocol or any other suitable protocol in the communication. For example, the control unit 120 may communicate with, and/or form part of, one or more displays in the operator cabin 114 for display of various data, e.g. with regard to the drilling process, and, according to embodiments of the present invention, current wear of the drill bit 108.

The control unit 120 may, according to embodiments of the invention, also communicate, e.g. via the CAN bus, with the accelerometer 115 for receiving signals from which a percussion frequency may be determined, e.g. by being estimated and/or frequency analysed. According to embodiments of the invention, the control unit 120 may also be configured to determine various drilling parameters, such as drilling depth, feed pressure, drilling rate etc.

With regard to the drill bit 108, this is subjected to wear during drilling, and becomes more and more worn as time (drilling) progress. It is oftentimes the case that a drill bit may be used for drilling a varying number of meters after which the drill bit needs to be replaced.

Figure 2A:
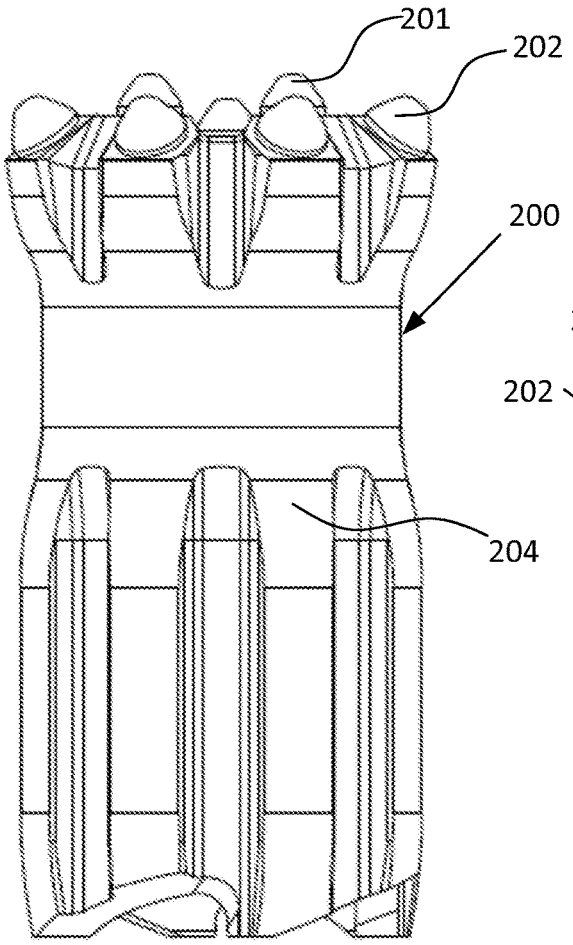
FIGS. 2A-B illustrates and exemplary drill bit.
Figure 2B:
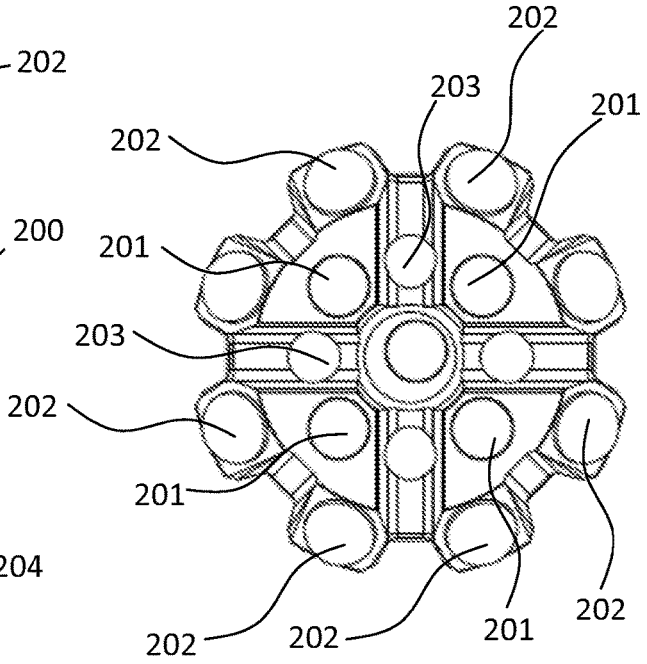

A drill bit in general comprises a plurality of drill bit inserts, or button bits, in the following denoted "drill bit inserts" or "inserts". During drilling, these inserts become worn, which, inter alia, deteriorates the drilling speed and increases wear on the overall drilling rig. Part of these inserts may be arranged at the periphery of the drill bit, peripheral inserts, which may be arranged at an angle with respect to the general direction of drilling. FIGS. 2A-B illustrates an example of a drill bit 200 of a kind which may be utilised according to embodiments of the present invention when estimating current wear of a drill bit. The drill bit 200 is illustrated in a side view in FIG. 2A and in a view from above in FIG. 2B.

The drill bit inserts are attached to the drill bit 200 in a more or less organised pattern across the working face of the drill bit 200. The inserts may, for example, constitute carbide inserts. The inserts, furthermore, are, according to the present example, arranged as two groups of inserts, where a first group, the front inserts 201, are axially oriented to provide direct drilling contact with the opposing bore hole surface, i.e. the surface in the drilling direction, indicated by arrow 117 in FIG. 1. The front, i.e. inner, inserts are encompassed by a circular array of peripheral inserts 202, which engage the drill hole surface, but at an inclined posture relative to the sidewall of the hole, and hence also in relation to the drilling direction. These peripheral inserts hence somewhat enlarge the hole diameter in relation to the general diameter of the drill bit 200. However, as the peripheral inserts become worn as drilling progress, the diameter of the drill bit is continuously reduced by the protrusion of the inserts being reduced due to the wear. Hence the drilled hole also becomes narrower and narrower as drilling progress. The drill bit body 204, which may be formed by steel, may also be subjected to wear and somewhat reduce in diameter. FIG. 2B also illustrates four symmetrically arranged flushing medium exhaust openings 203 which are used to discharge flushing medium for flushing away drill remnants/cuttings and/or for providing cooling of the drill bits.

Figure 3A:
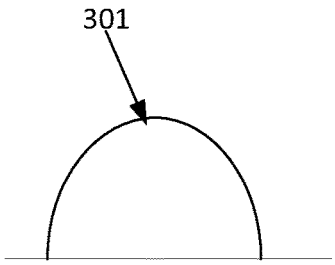
FIGS. 3A-C illustrates exemplary states of wear of a drill bit insert.
Figure 3B:
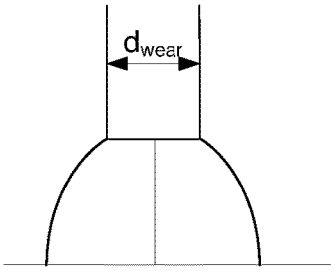
Figure 3C:
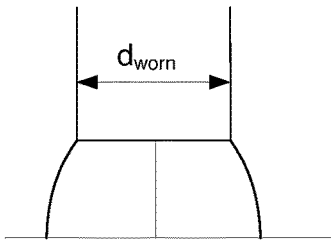

FIGS. 3A-C illustrates exemplary possible states of wear of an exemplary drill bit insert of the inserts of FIGS. 2A-B.

FIG. 3A illustrates an insert of a drill bit that has not yet been taken into use, and which hence has not yet been subjected to wear. As can be seen from the figure, the insert is of a generally semi-spherical design. It is to be noted that the inserts may be of various different designs, such as semi-spherical, semi-ballistic, full ballistic etc., and the invention is valid for any such design. The most protruding point or portion 301 will be subjected to the highest force when the insert contacts the rock face upon the drill bit being pushed against the rock face and stricken by the hammer to thereby transfer shockwaves into the rock for breaking the rock. This part of the insert will therefore also be subject to most of the wear, as drilling progress.

FIG. 3B illustrates the insert of FIG. 3A following a time of drilling, where the outermost portion will wear essentially flat as time (drilling progress). The flattened, i.e. worn down, portion will exhibit a first diameter $d_{wear}$, and when the diameter $d_{wear}$ of the flattened portion of the insert has reached a limit value $d_{worn}$, it is time to replace the drill bit. This is illustrated in FIG. 3C. The particular diameter $d_{worn}$ of the flattened portion at which it is considered that the drill bit is to be replaced may depend e.g. on type of drill bit and/or general diameter of the insert and/or other parameters, and be determined, for example, as a diameter representing a state of wear that negatively impacts the drilling rate, i.e. speed at which the drilling of the hole progress, to a predetermined extent.

Hence, in case the inserts become too worn, exemplified by the state of FIG. 3C, it will no longer be possible to continue efficient drilling in a desired manner, and the drill bit must be replaced as discussed above.

In case the drill bit inserts become worn to the extent that reduces the drilling rate so that a hole that is currently being drilled is not possible to complete when only part of a hole has been drilled, such as e.g. in the situation of FIG. 1, it may be difficult to retract the drill string and drill bit to replace the drill bit with a new drill bit. This is because, for example, the drill bit diameter will decrease as drilling progress, e.g. because of wear, and in particular because of wear of the peripheral inserts. This, in turn, may have as result that a new drill bit may have too large a diameter and therefore be difficult or impossible to insert into the already drilled part of the hole all the way to the bottom to continue drilling. In case it is attempted to insert the drill bit by force and/or ream the drilled part of the hole using a new drill bit of a somewhat larger diameter, the drill bit may also get stuck and/or the walls of the hole may rupture and damage the hole.

It may sometimes be possible to utilize a previously worn drill bit that has been re-sharpened, re-grinded, for further use, and where hence the diameter has already been reduced by prior wear. The inserts of a drill bit of the kind disclosed in FIGS. 2A-B may in general be re-sharpened a number of times before the inserts have been reduced in size to an extent where the drill bit no longer can be used without replacement of the inserts. Use of such a re-sharpened, and thereby of a reduced diameter, drill bit may be possible to use in situations of the described kind. However, such a drill bit may still be difficult to insert into the hole, and still with the risk of damaging walls of the already drilled portion of the hole as the drill bit and drill string is inserted, and still with the oftentimes tedious work of having to retract the drill string which may comprise a number of drill string components being threaded together to replace the drill bit and subsequently again be assembled to continue drilling. Use of a re-sharpened drill bit also requires presence of re-sharpened drill bits at the drilling site. This may be both cumbersome and impractical, and also give rise to undesired and tedious logistics.

In view of this, when a drill bit becomes too worn to be used, is oftentimes decided to abandon the partially drilled hole and instead drill a new hole next to the abandoned hole. Such situations are undesirable and increases production time and costs involved in the drilling process. According to embodiments of the present invention the risk for such situations arising may be reduced.

This may be accomplished by estimating the current wear of the drill bit, in particular the wear of the drill bit inserts. According to embodiments of the invention, the wear is estimated as a measure, e.g. in the form of a remaining number of meters or feet, and/or drill rods, of the depth/length that may be drilled prior to the drill bit needs to be replaced. In this way it may be determined, prior to drilling a subsequent hole, whether the remaining drilling capacity of the drill bit will be sufficient to complete the subsequent hole without a substantial risk for the drill bit becoming too worn prior to completing a commenced hole. According to embodiments of the invention, this determination may also be made already at the beginning of the drilling of a hole, so that the drilling may be aborted at an early stage in case it is determined that the hole may not be completed using the current drill bit. According to embodiments of the invention, the estimations may be performed e.g. in a control unit of the drill rig, such as control unit 120 of FIG. 1.

An exemplary method 400 according to embodiments of the invention will be discussed in the following with reference to FIG. 4. The method 400 starts in step 401, where it is determined whether the wear of a drill bit is to be estimated. When this is the case the method may continue to step 402, otherwise the method remains in step 401. The estimation of wear of the drill bit, and hence transition from step 401 to step 402, may be arranged to take place e.g. continuously as drilling is ongoing, or e.g. at suitable intervals, such as when a certain period of time has lapsed, and/or when a certain number of meters have been drilled. According to embodiments of the invention, the state of wear is estimated as soon as drilling has started, or within a predetermined period of time from when drilling of a hole has started, and may then be continuously carried out during the drilling of the hole. According to embodiments of the invention, there may also be further requirements regarding the transition from step 401 to step 402. For example, it may be required that once drilling of a hole has commenced, at least a pre-determined depth of the hole has been drilled e.g. in order to ascertain that any loose or semi-loose layers have been penetrated and drilling into solid rock has commenced. There may also be requirements e.g. regarding drilling pressure, i.e. that the drilling has reached a state where normal drilling pressure, such as the pressure of the fluid powering the percussion device, and/or drilling rate, has been reached. According to embodiments of the invention, there are no such requirements, and according to embodiments of the invention the operator may be notified that the current drilling conditions are such that the estimation of the state of wear may not yet have reached the highest accuracy.

In step 402 a representation of the percussion frequency is determined. This may be determined in various different manners. According to the present example, as discussed above, an accelerometer 115 is arranged for sensing accelerations that the drill string 107 is subjected to and may, for example, be situated e.g. on top of the rotation unit 105. However, various others possible positions are contemplated as well. For example, the accelerometer may be arranged at any suitable location on the feeder, the carrier, the drill string support, and also along the drill string, e.g. in connection to and/or integrated in the DTH hammer. It is also contemplated that the percussion frequency may be determined in any suitable manner, and hence utilising any suitable device and/or method for determining the percussion frequency. For example, in case the percussion device, which according to embodiments of the invention need not be a down-the-hole percussion device, is instead e.g. hydraulically driven, the percussion frequency may be detected e.g. by pressure changes of a hydraulic pressure, such as a damping pressure of a damping mechanism of the percussion device, or any other pressure that comprises pressure changes reflecting the percussion frequency in the system. Similarly, with regard to a pneumatically driven percussion device as in the present example, the percussion frequency may be determined from pressure signals reflecting the percussion frequency and delivered by a pressure sensor being arranged at any suitable location such as being arranged e.g. in connection to a percussion piston of the percussion device, or at any other suitable location, and which generates shock waves by reciprocating action against the drill bit (e.g. via a drill shank etc. as may oftentimes be the case).

Returning to the present example, the signals from the accelerometer 115 may be utilized to determine a percussion frequency from the accelerations that the drill string 107 is subjected to by hammer acting on the drill bit and/or the drill bit action against the rock. The signals from the accelerator may, for example, be supplied to the control unit 120, e.g. using the data bus or by a direct connection, for processing in the control unit 120 which may then determine a current percussion frequency by suitable signal processing such as frequency analysis of the received signals. The method then continues to step 403, where, according to the present example, the determined percussion frequency is input into a model representation representing wear of the drill bit, and where the model representation outputs a current state of wear in response to the input percussion frequency.

As will be explained below, further parameters may also be input into the model representation, which may further increase the accuracy in the estimated level of wear. The input percussion frequency may, according to embodiments of the invention, be a normalised percussion frequency, where the percussion frequency may be normalised in relation to the prevailing pressure of the fluid powering the percussion device. However, whether this be the case or not may depend on the particular model being used, where the model representation may be a data driven model, where the parameters of the model may be generated from the recorded data relating to one or more parameters during drilling. An exemplary method for generating the model is discussed below. When a state of wear has been estimated using the percussion frequency and model representation, the resulting estimated wear may e.g. be displayed, step 404, e.g. on a display in the operator cabin, to thereby make aware the operator of the current state of the drill bit being in use. According to embodiments of the invention, this information may instead be utilised by the control system e.g. in autonomous drilling where the control system may replace drill bits on the basis of the estimated wear. When the wear has been estimated, the method may return to step 401 for a new estimation of the state of wear.

Figure 4:
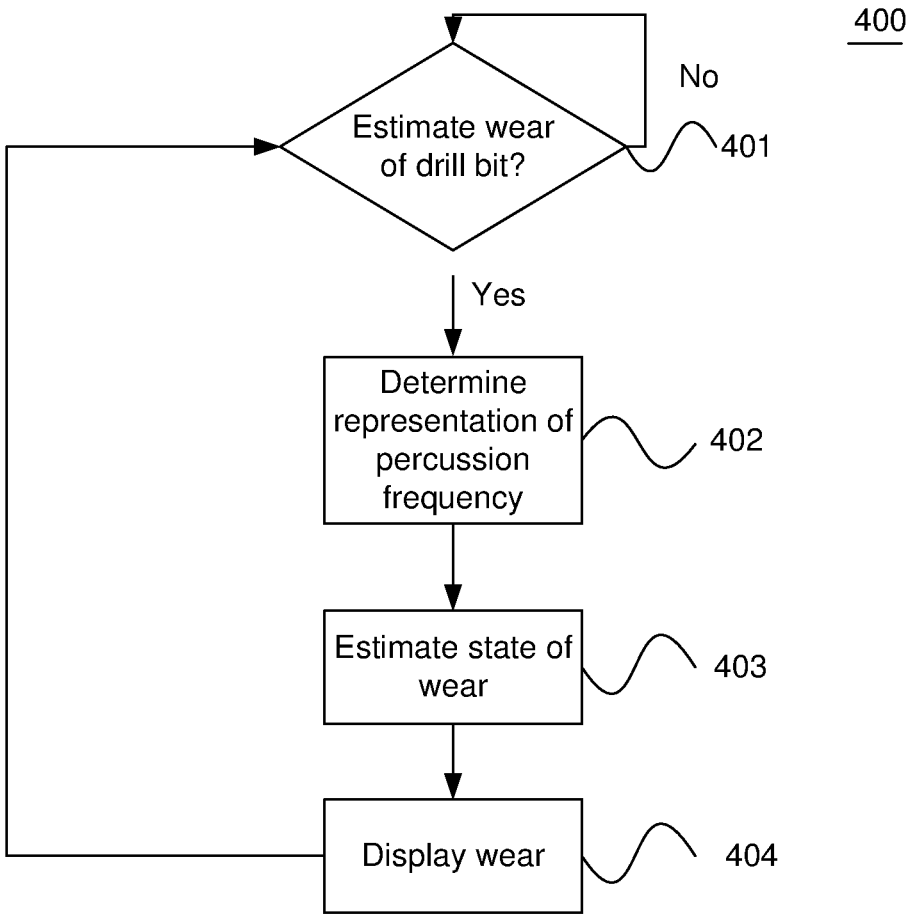
FIG. 4 illustrates an exemplary method according to the invention.

With regard to the method of FIG. 4, it may, according to embodiments of the invention, comprise a step where a current pressure of the fluid powering the percussion device is determined. The pressure may be utilised to ensure/determine that an appropriate model representation is utilised, and/or to be used in normalisation of the percussion frequency as described below. Alternatively, it may be determined that drilling is ongoing at normal drilling pressure. In general drilling is carried out such that the pressure of the fluid powering the percussion device is maintained at a constant pressure, where the pressure of the fluid powering the percussion device need not be determined specifically, but may e.g. be a maximum or otherwise pre-set pressure being used. In case the percussion pressure is determined, this may e.g. be determined as the pressure being supplied to the DTH hammer 106, where this pressure may hence be the pressure of the compressed air being supplied, and where the pressure may e.g. be represented by the pressure that currently prevail in the tank 109 and/or a pressure determined by some other suitable arranged pressure sensor. For example, the pressure of the fluid powering the percussion device may be determined as the pressure delivered by the compressor 110. The pressure of the fluid powering the percussion device may also be represented e.g. by the flow of compressed air being supplied to the DTH hammer 106. Further parameters may also be determined and used in the model representation as explained below.

Figure 5:
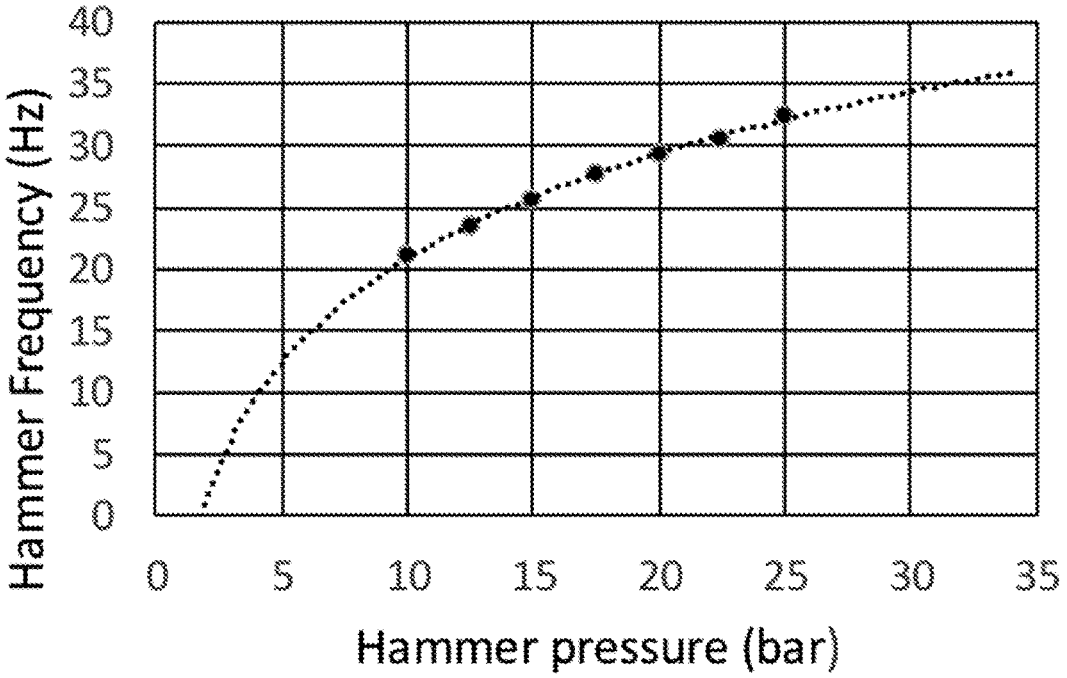
FIG. 5 illustrates a dependency between percussion frequency and pressure of the fluid powering the percussion device.

The generation of the model representation of the state of wear will be exemplified in the following. The inventors of the present invention have realised that the percussion frequency will change, in particular increase, for a given pressure of the fluid powering the percussion device as the drill bit becomes more and more worn, and this is utilised according to the present invention. The percussion frequency, however, is also dependent on the pressure of the fluid powering the percussion device. This is illustrated in FIG. 5 for a pneumatic DTH hammer of the kind disclosed in FIG. 1. The x-axis represents pressure of the fluid powering the percussion device, denoted hammer pressure, expressed in bars, and the y-axis represents hammer frequency expressed in Hz. The figure illustrates that the hammer frequency increases as the hammer pressure increases. The increase, however, is not linear, and an increase above a certain pressure, e.g. approx. 50-60 bar according to the present example, will not give rise to any essential further increase in hammer frequency. This is e.g. due to friction and heat that increase as the pressure increase, and there may therefore also be a maximum pneumatic hammer pressure that is feasible to use. The upper limit may depend on various factors, such as hose/pipe diameters, flow, etc.

The realisation that the percussion frequency increases with wear of the drill bit is however not apparent. This is because of a number of reasons. For example, there is in general no exact determination of the percussion frequency during drilling, but in general it is relied upon dependencies such as the one disclosed in FIG. 5 and the process relies on pressures instead. That is, there may simply not be present any sensors for directly measuring the percussion frequency being used. Furthermore, even if the percussion frequency is measured, there may be no evident indication that the percussion frequency increases as the drill bit becomes worn. For example, the actual hammer (air) pressure prevailing at the DTH hammer may decrease as the drill string extends due to increased losses, but where this decrease may be counteracted by the increased wear. There may therefore not be any evident trend in differences in percussion frequency, if any, as drilling progress.

Still, as was discussed, it has been realised that it is possible to generate a model for estimating wear of the drill bit as a function of the percussion frequency, where this model may be a data driven model.

When generating a model according to the invention, current, i.e. actual, wear of the drill bit may be measured at regular intervals, such as e.g. each time a drill string component is to be added to the drill string, or when a predetermined time of drilling has lapsed, and/or when the drilling has advanced by some predetermined distance. In this way, the measured actual wear may be used as the target that the output from the model should generate from the input signals, i.e. the determined percussion frequency according to the present example, and possible further parameters being utilised in the generation of the model. The percussion frequency is logged as the drilling progress, so that the measured wear can be correlated, synchronised, in time with determinations of the percussion frequency that prevailed for a particular state of wear.

When sufficient data has been collected for generating the model representation of the wear of the drill bit, the model may be generated e.g. utilising existing tools for such generation. As is known to the person skilled in the art there exist various tools for generating models from collected data, and such tools may attempt to use various different models utilising one or more from the input signals forming part of the model generation. A valid model may then be generated by such tools as result.

In addition to percussion frequency, various other parameters may be logged and utilised in the generation of the model representation of wear. The percussion frequency, however, is the most significant parameter, and hence the parameter that contributes the most to an accurate estimation of the wear of the drill bit. A model solely relying on the percussion frequency may therefore oftentimes provide sufficient accuracy.

Furthermore, when collecting data for the generation of such a model, some parameters may be arranged to be determined and/or estimated continuously and/or at regular intervals. With regard to the percussion frequency, for example, this may be configured to be determined frequently, e.g. since the signal in general will always be available. With regard to e.g. current wear of the drill bit, on the other hand, this may be arranged to be determined at more sparse intervals. For example, as was mentioned, the current wear of the drill bit may be determined each time a drill string component is to be added to the drill string, or when a predetermined time of drilling has lapsed, and/or when the drilling has advanced by some predetermined distance.

It is in general relatively cumbersome to retract a drill string to reach the drill bit and measure the current wear. Although it is possible to retract the drill string each time a relatively short distance has been drilled, this is time consuming, and therefore it may be to prefer to determine the wear less frequently, such as each time the drilling is stopped to add a further drill string component, or as frequently as is feasibly possible. The wear may also be arranged to be determined only at every x meters, or for every x drill rod component being added to the drill string. For example, every 1-10 meters, every 1-10 drill rods, or at any other suitable interval. According to embodiments of the invention, it is hence not necessary to actually measure the wear very frequently. Instead, the wear over time, in case needed for the model generation, may, in case this is required, be interpolated for depths in between depths for which actual measurements of wear have been carried out. Interpolation may give accurate intermediate measurements between actual measurements.

Furthermore, the wear may be measured for one or more of the drill bit inserts, and in case the wear is different for different inserts, an average value of a plurality of, or all of, the drill bit inserts may be utilised. Different model representations may also be utilised for different types of inserts on a single drill bit, such as for front inserts and peripheral inserts.

During the generation of the model representation the measured drill bit wear may be used as the target that the output from the model is to generate from the input signals, i.e. the determined percussion frequency according to the present example, and possible further parameters being utilised in the generation of the model.

Figure 6:
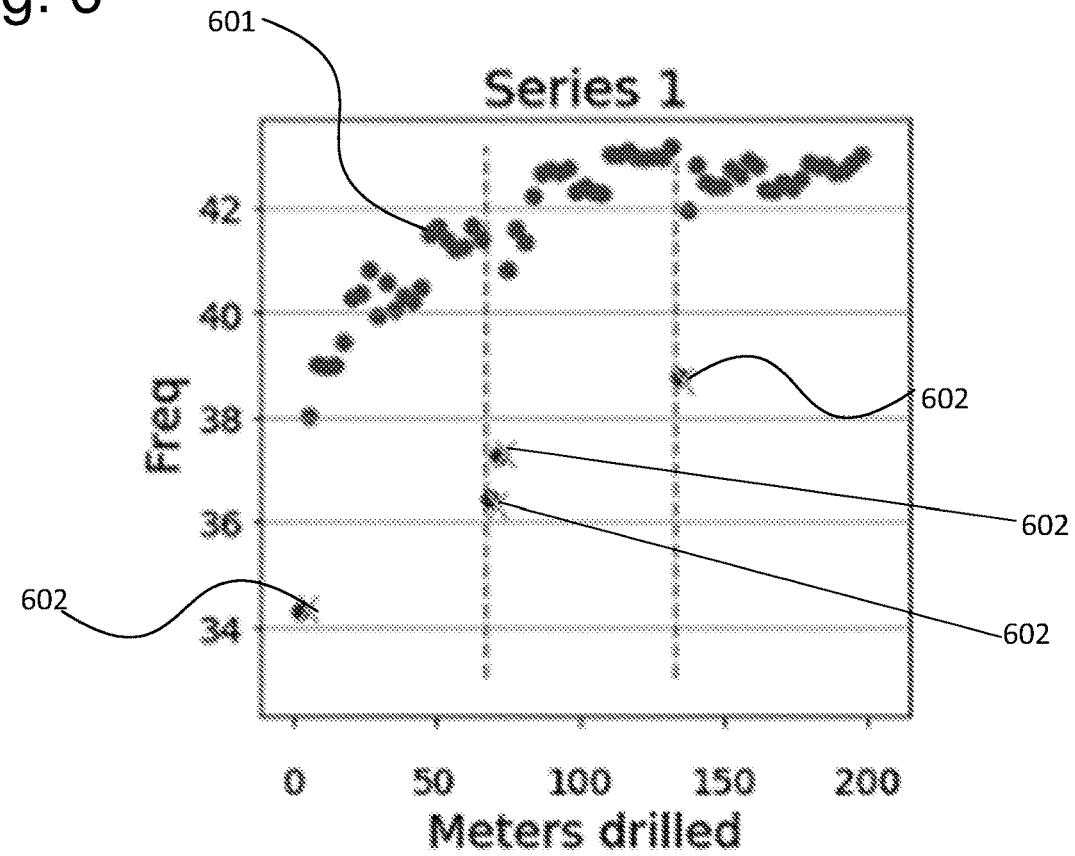
FIG. 6 illustrates exemplary measures of percussion frequency in relation to hole depth.

As was mentioned, various models may be evaluated. Alternatively, e.g. a suitable model may be already known from previous model generations, and thereby be immediately selected. FIG. 6 illustrates a number of readings 601 representing logged percussion frequency as a function of drilled meters, where the drilled length may represent a single hole being drilled or be divided by drilling a number of holes of the same or different length. This data, together with the measurements of wear, may hence be input into a model generator. Apparently abnormal readings, marked by an "x", also denoted 602 in FIG. 6, may be omitted. Such readings may e.g. represent situations where drilling has not yet reached normal drilling levels, e.g. following the addition of a drill rod to the drill string and/or represent measurements from the beginning of the drilling of a hole. Such abnormal readings may also be the result e.g. from accelerometer data that is not correctly interpreted and/or momentarily does not properly reflect the prevailing percussion frequency. According to embodiments of the invention, a number of series may be drilled, e.g. 3 or 4 or a significantly higher number of series, e.g. 10-20 or more, and hence measurements may be performed for a plurality of drill bits prior to generating the model representation. In general, it may be preferable to include data from as many series as is considered feasible. Furthermore, the drilling of a number of series may be performed for each of a number of combinations with regard to e.g. drill rig configuration, such as in terms of drill bit, percussion hammer etc.

Figure 7A:
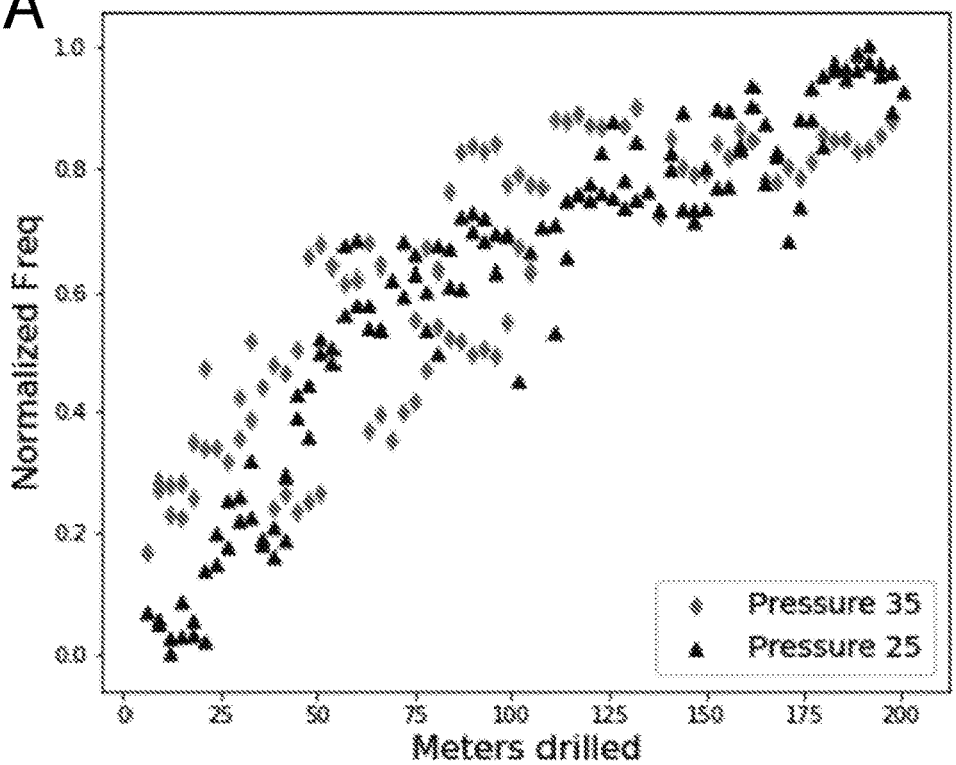
FIG. 7A illustrates normalised percussion frequencies as a function of hole depth for two different pressures of a fluid powering a percussion device.
Figure 7B:
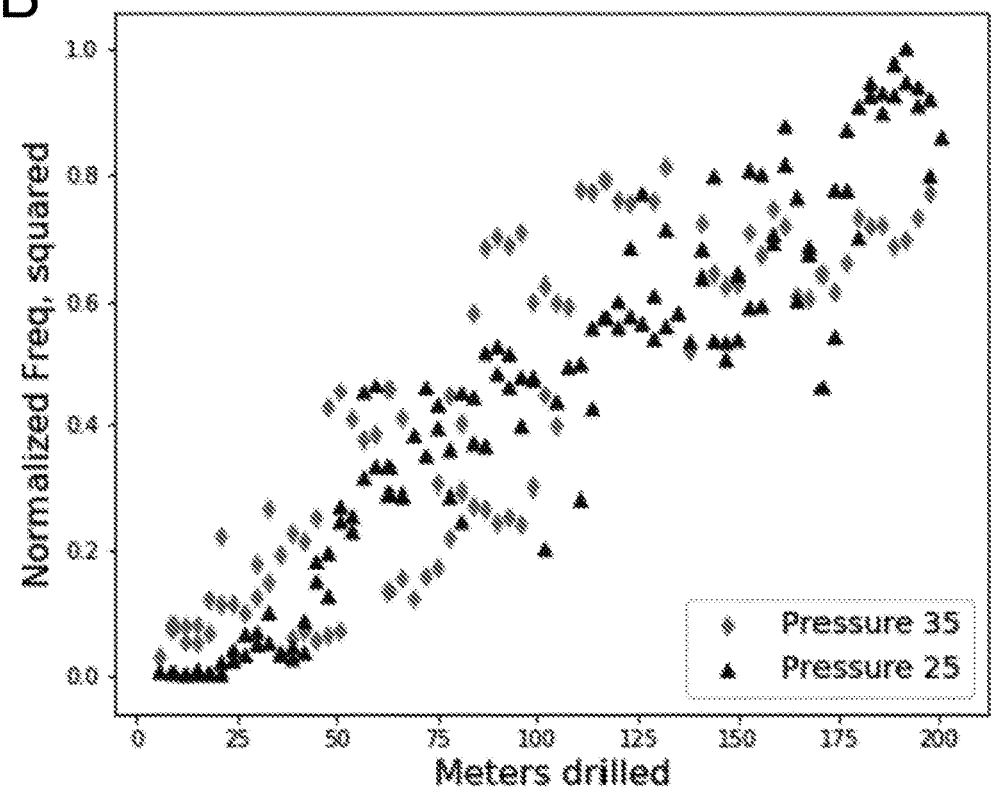
FIG. 7B illustrates the normalised percussion frequencies of FIG. 7A squared.

The percussion frequency may be utilised in various different manners, and according to embodiments of the invention the percussion frequency may be normalised, and the normalised percussion frequency may also be squared. This is exemplified in FIG. 7A, where the percussion frequency of a plurality of different drilling series have been normalised and presented in relation to drilled length. The percussion frequency may be normalised in relation to a representation of the pressure of the fluid powering the percussion device that prevailed during the measurements. The normalisation has the advantage, inter alia, that data from the drilling series forming part of the model generation may comprise data collected during drilling at different pressures of the fluid powering the percussion device, and this is also illustrated by the figure where drilling series at 25 bar and 35 bar, respectively, are represented and utilised together in the model generation. FIG. 7B illustrates the normalised percussion frequencies of FIG. 7A, however being squared, i.e. raised to the power of two. In general, measurement results from a plurality of drilling series may be utilised in the generation of the model representation.

Furthermore, different models may be generated for the peripheral drill bits inserts and the front inserts. That is, one model may be generated for the peripheral inserts, and a separate model may be generated for the front inserts. The drill bit inserts may also be divided further in different groups in case this is would to prefer, or alternatively be treated in unison. According to embodiments of the invention, only the peripheral inserts are contemplated. This is because the peripheral inserts may be worn faster than the front inserts.

Figure 8:
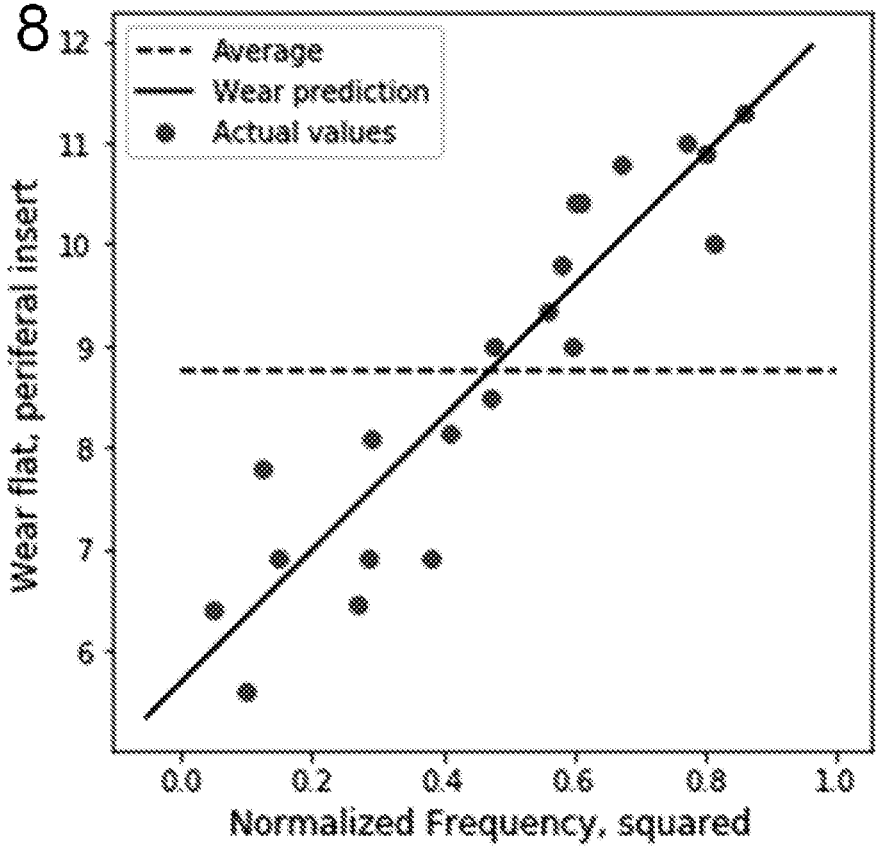
FIG. 8 illustrates an exemplary dependency of drill bit wear in relation to the normalised percussion frequency squared.

According to the present example, the wear of the peripheral drill bit inserts is modelled. An exemplary resulting wear is illustrated in FIG. 8, where the wear of the peripheral drill bits is given as a function being proportional to the normalised percussion frequency squared. FIG. 8 exemplifies wear in terms of flattened portion of the drill bit inserts as a function of the percussion frequency. The wear is represented by millimetres flattened portion.

This model may then be utilised e.g. in the control system of the drill rig, which, following a determination of the percussion frequency, may input the percussion frequency to the model representation, which may then output the current wear. Hence as soon as drilling has commenced and stabilised, i.e. the pressure of the fluid powering the percussion device has reached the nominal pressure and the drilling has proceeded into solid material from the oftentimes occurring grout, the current wear of the drill bit may e.g. be displayed on a display in the operators cabin. The current wear may e.g. be represented as a remaining number of meters that may be drilled until the drill bit is considered worn to the extent where it needs to be replaced. The current wear may also be displayed e.g. in terms of current diameter of the worn flat portion of the drill bit, or percentage of the remaining drilling capacity, or by any other suitable representation.

Figure 9:
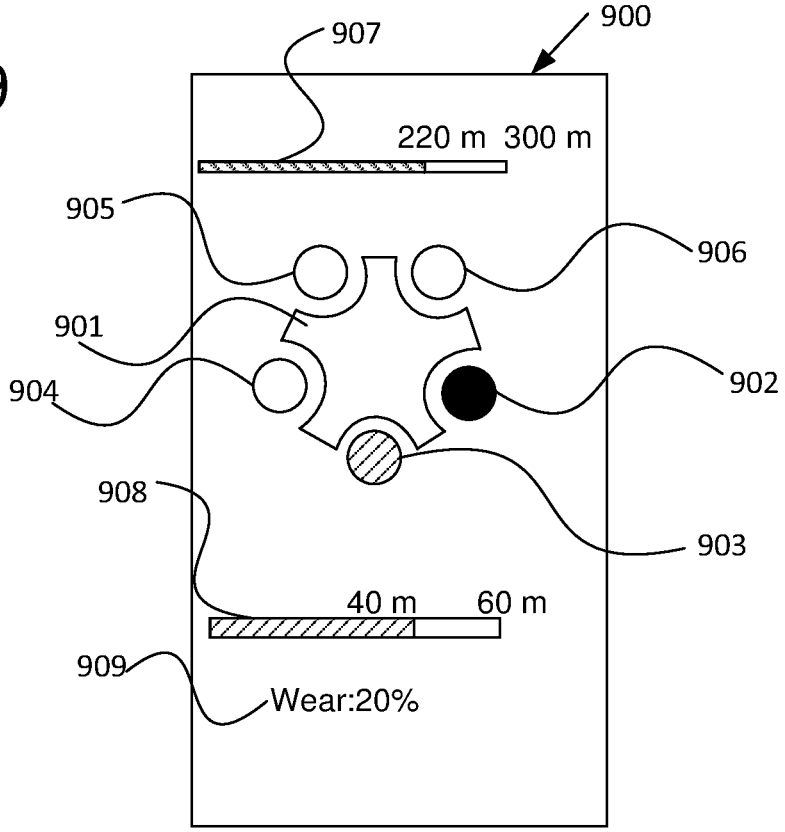
FIG. 9 illustrates presentation of wear on a display.

FIG. 9 illustrates an exemplary method of presenting data regarding the drill bit wear. In particular, FIG. 9 exemplifies a portion 900 of a display that may be utilised to present data to an operator during drilling. FIG. 9 further relates to a drill rig comprising a drill bit magazine, the magazine being illustrated by symbol 901, and where each of the five drill bits comprised in the magazine are graphically represented by circles 902-906. Drill bit 902 has already been used in drilling and is worn, which according to the present example is illustrated by a filled circle. Drill bit 903 is currently being used in drilling, indicated by a hashing, while the drill bits 904-906 are yet to be used. In reality, e.g. colour coding of the various states of the drill bits may be utilised, e.g. red for worn, green for unused and yellow for a drill bit currently being used. Any other representation may also be utilised.

FIG. 9 further illustrates a status bar 907, which indicates the total number of meters that can be drilled using the current magazine, i.e. 300 m in the present example. The status bar 907 further illustrates the number of meters that currently remain to be drilled (220 m). FIG. 9 also discloses a similar status bar 908, which illustrates the total and remaining number of meters that can be drilled using the drill bit 903 that is currently being utilised. The wear flat portion is also indicated as a percentage, e.g. representing the diameter of the flat portion of the inserts in relation to the maximum diameter of the inserts. As is realised, any other suitable method may alternatively be utilised to present data relating to the wear of a drill bit to an operator.

As is realised, a single type of drill rig may utilise different hammers, and drill bits of different diameters and/or drill bit insert configuration, and also different variants of drill rods. A model generation will in general be valid for a single percussion hammer—drill bit configuration, and various models may be generated for combinations being utilised. The generated model representations may then be stored in the control system of the drill rig for use e.g. during the service life of all drill rigs for which the model representations are applicable, so that an estimation of the wear of the drill bit may be performed for the particular combination being utilised. Different models may also be generated for different types of drill rigs, and/or different combinations of drill rig, percussion hammer, drill bit etc.

The use of only percussion frequency in the model generation as above may exhibit a high correspondence the actual wear and may be sufficient in terms of accuracy. Tests using cross-validation, i.e. the modelled results have been compared to actual results, have also revealed a high accuracy for use of percussion frequency only, where use of further parameters may further increase the accuracy.

As was discussed, the wear may be represented by any other suitable representation, such as meters remaining to be drilled prior to replacement being required.

According to embodiments of the invention, further parameters may be utilized both as input parameters in addition to the percussion frequency in the generation of the model and thereby also when determining the wear.

For example, current hole depth may be utilised to account e.g. for losses in percussion pressure as discussed above, e.g. caused by pressure losses in the drill string prior to the fluid reaching the percussion hammer. This data may also be logged together with the other parameters being utilised in the subsequent model generation. The hole depth may be expressed e.g. in meters or as number of drill rods.

Control systems of drill rigs of the disclosed kind in general comprises routines for keeping track on the current drilled depth of a hole, and hence such data will in general already be available in the control unit 120 and/or on the data bus for use as input signals to the model representation during normal use of the machine.

Furthermore, e.g. the rate of penetration, i.e. drilling rate may be determined and logged for use in the generation of the model, and subsequently in the use of the model when determining wear. A further parameter that may be utilised is weight on bit (WOB), e.g. represented by the feed force, which in turn e.g. may presented by feed pressure, that is used to press the drill bit against the rock being drilled. The weight on bit (WOB) will also depend on the number of drill rods, and the weight of the drill rods and/or percussion device may also be accounted for in this regard.

When a plurality of parameters are utilised, these parameters are used in addition to the percussion frequency as input signals to the model generator for the corresponding wear, where the model generator outputs a representation depending on one or more or all of these parameters. As is realised, other parameters may be utilised as well, but the wear may not be dependent on all such parameters. One or more such parameters may also be normalised. For example, the drilling rate may be normalised in relation to e.g. the pressure of the fluid powering the percussion device and/or feed force.

As was mentioned, separate model representations may be generated for the front inserts and the peripheral inserts.

Although model representations may be generated from a relatively low number of holes being drilled/number of drill bits participating in the data collection, increased amounts of data may increase the reliability of the measurement results.

According to embodiments of the invention, a compensation factor may be utilised to account for deviations in the model in relation to reality, e.g. to compensate for differences in rock structure etc. to reduce the risk for a drill bit becoming worn earlier than anticipated by the model in case this is considered needed. Such differences may also be accounted for e.g. by the drilling rate.

According to embodiments of the invention, the invention is utilised in automated drilling, where the bit wear indicator according to the invention may be utilised for automatic change of drill bits. The change of drill bit may then be carried out automatically by a drill bit changer mechanism. This may significantly extend rig time of un-serviced drilling since the risk for the drill bit becoming worn out during ongoing drilling of a hole may be substantially reduced. The drill rig control system may also be configured to store current wear of each drill bit of a drill bit magazine, so that a proper drill bit may be selected and replaced in dependence of the hole depth that is currently to be drilled.

Hitherto the invention has been described largely with reference to a drill rig where drilling is performed using a DTH hammer. However, as was discussed, the present invention may be utilised for essentially any kind of drill rig where percussive drilling is utilised. Furthermore, the percussion frequency may be determined in any suitable manner, utilising any suitable means, and be determined e.g. from pressure pulses of a hydraulic fluid generated by a piston or other shockwave generating means. The invention is also applicable for underground drill rigs as well drill rigs operating above ground.

The invention claimed is:

1. A method for estimating wear of a drill bit in percussive rock drilling, wherein a percussion device is configured for generating shock waves in a drill bit for breaking rock, the method comprising, during drilling:

determining a percussion frequency of the percussion device;

estimating wear of the drill bit based on the determined percussion frequency of the percussion device and a model representation of the wear of the drill bit as a function of percussion frequency, wherein the model representation is configured to output the estimated wear of the drill bit utilising the determined percussion frequency as input signal; and generating a signal representing a current state of wear of the drill bit.

2. The method according to claim 1, further comprising:

in addition to determining the percussion frequency, determining at least one additional parameter, wherein the model representation is configured to output the estimated wear of the drill bit utilising the determined percussion frequency and the at least one additional parameter as input signal, wherein the at least one additional parameter include one or more from:

rate of penetration at which the drilling progress;

weight on bit and/or feed force acting on the drill bit during drilling; or currently drilled hole depth, and/or current length of the drill string.

3. The method according to claim 1, wherein:

the signal representing the state of wear indicates one or more from:

a number of meters of drilling remaining until the drill bit needs to be replaced;

a representation of the percentage of use of the current drill bit; or a measure of a wear flat portion of drill bit inserts of the drill bit.

4. The method according to claim 1, further comprising:

displaying a current state of wear of the drill bit to an operator operating the rock drilling.

5. The method according to claim 4, further comprising:

displaying the current state of wear of the drill bit as one or more from:

a remaining number of meters that may be drilled until the drill bit is considered worn to the extent where it needs to be replaced;

a current diameter of a worn flat portion of the drill bit inserts in relation to the overall diameter of the drill bit inserts;

a percentage of the remaining drilling capacity of the drill bit, or by any other suitable representation; or displaying the current state of wear of the drill bit for each drill bit of a plurality of drill bits of a drill bit magazine.

6. The method according to claim 1, wherein:

the model representation of the wear of the drill bit is a model representation generated by, during drilling:

measuring a state of wear of a drill bit for a plurality of different drilled distances during drilling with the drill bit, determining and recording a representation of the percussion frequency at least for the corresponding drilled distances for which the state of wear is determined, and the model representation being a data driven model representation, parameters of the model being generated from the measured state of wear and corresponding percussion frequency.

7. The method according to claim 6, further comprising:

determining and recording a representation of the percussion frequency continuously and/or at predetermined intervals, and/or a plurality of times between each measurement of the state of wear of the drill bit.

8. The method according to claim 6, wherein:

the model representation is generated from measurements of the state of wear and corresponding percussion frequencies for a plurality of drill bits, wherein the model generation involves measuring the state of wear for a plurality of different drilled distances for each of a plurality of drill bits, and determining corresponding percussion frequencies for the measured state of wear for the plurality of different drilled distances for each of a plurality of drill bits.

9. The method according to claim 1, wherein the model representation is a model representation that has been generated utilising a normalised percussion frequency and/or the normalised percussion frequency squared.

10. The method according to claim 1, wherein the model representation is a model representation that has been generated utilising a plurality of parameters as input signals for a state of wear.

11. The method according to claim 10, wherein the plurality of parameters include, in addition to the percussion frequency, one or more from:

rate of penetration at which the drilling progress;

weight on bit and/or feed force acting on the drill bit during drilling;

currently drilled hole depth, and/or current length of the drill string.

12. The method according to claim 1, further including:

utilising a plurality of model representations for a plurality of drill bits, and/or combinations of a plurality of drill bits, a plurality of percussion devices, and a plurality of drill strings.

13. The method according to claim 12, wherein the plurality of drill bit comprising drill bit inserts and a state of wear of the drill bit inserts.

14. The method according to claim 13, wherein the plurality of drill bit comprising a plurality of front drill bit inserts and a plurality of peripheral drill bit inserts, and wherein a first model representation is utilised for the front drill bit inserts and a second model representation is utilised for the peripheral drill bit inserts.

15. A computer program comprising instructions which, when the program is executed by a computer, cause the computer to carry out the method according to claim 1.

16. A computer-readable medium comprising instructions which, when executed by a computer, cause the computer to carry out the method according to claim 1.

17. A system for estimating wear of a drill bit in percussive rock drilling, wherein, during drilling, a percussion device is configured for generating shock waves in a drill bit for breaking rock;

the system comprising:

at least one control unit configured to:

determine, during drilling, a percussion frequency of the percussion device;

estimate wear of the drill bit based on the determined percussion frequency of the percussion device and a model representation of the wear of the drill bit as a function of percussion frequency, wherein the model representation is configured to output the estimated wear of the drill bit utilising the determined percussion frequency as input signal; and generating, during drilling, a signal representing a current state of wear of the drill bit.

18. A rock drilling rig comprising a system according to claim 17.

* * * * *